US005251660A

United States Patent [19]

Hori et al.

[11] Patent Number: 5,251,660

[45] Date of Patent: * Oct. 12, 1993

[54] HYDRAULIC PILOT VALVE UNIT

[75] Inventors: Shyuji Hori, Kawasaki; Jun Maruyama, Yokohama, both of Japan

[73] Assignee: Kabushiki Kaisha Komatsu Seisakusho, Tokyo, Japan

[ * ] Notice: The portion of the term of this patent subsequent to Sep. 12, 2007 has been disclaimed.

[21] Appl. No.: 442,068

[22] PCT Filed: Mar. 31, 1989

[86] PCT No.: PCT/JP89/00339

§ 371 Date: Jan. 25, 1990

§ 102(e) Date: Jan. 25, 1990

[87] PCT Pub. No.: WO89/09360

PCT Pub. Date: Oct. 5, 1989

[30] Foreign Application Priority Data

Mar. 31, 1988 [JP] Japan ..... 63-76298

[51] Int. Cl.[5] ..... F15B 13/06

[52] U.S. Cl. ..... 137/636.1; 137/596; 137/596.1

[58] Field of Search ..... 137/596, 596.1, 636.1

[56] References Cited

U.S. PATENT DOCUMENTS 4,184,512 1/1980 Pignolet ..... 137/596

FOREIGN PATENT DOCUMENTS 54-100225 7/1979 Japan .

59-39379 3/1984 Japan .

*Primary Examiner*—Gerald A. Michalsky

*Attorney, Agent, or Firm*—Frost & Jacobs

[57] ABSTRACT

A hydraulic pilot valve unit constructed with an aim of controlling the flow rate of fluid under pressure in proportion to the stroke of the operating lever, irrespective of the speed of operation of the lever, and adapted for use in supply of pilot fluid under pressure by a pilot fluid actuated type changeover valve or the like arranged to be actuated for switch-over by pilot fluid under pressure. This hydraulic pilot valve unit includes valve spools 23 each being slidably movable between a first position where the pilot fluid under pressure supplied by a pilot pressurized fluid supply pump (27) is allowed to flow into outlet ports (26) formed in the valve body (1), and a second position where the outlet ports are allowed to communicate with a reservoir port (30) formed for drainage purposes. The arrangement is made such that the force applied by the operator to the operating lever (38), which is adapted to slidably move the valve spools, can be transmitted to the latter by a damper effect developed in damper chambers.

1 Claim, 4 Drawing Sheets

HYDRAULIC PILOT VALVE UNIT

TECHNICAL FIELD OF THE INVENTION

This invention relates to a hydraulic pilot valve unit for supplying pilot fluid under pressure into a pilot fluid actuated type switch-over valve or the like adapted to be actuated for switch-over by pilot fluid under pressure, and more particularly to a hydraulic pilot valve unit arranged to control the discharge rate of pilot fluid under pressure in proportion to the stroke of an operating lever.

BACKGROUND TECHNIQUE OF THE INVENTION

As a conventional hydraulic pilot valve unit of the kind specified above, there is known a valve unit as shown, for example, in FIG. 1.

Stating in brief, this valve unit has a valve body 1 having a plurality of axially extending valve holes 2 formed within the valve body 1 along the circumference of the latter, and a valve spool 3 slidably mounted in each of these valve holes 2. Each of the valve spools 3 has formed therein a radial hole 4 for pressurized fluid which opens in a small diameter portion 3*a* formed on the approximately intermediate axial portion thereof, and an axial hole 5 for pressurized fluid, one end of which communicates with the radial hole 4 and the other end of which opens in the base end surface 3*b* of the valve spool.

The valve body 1 has further formed axially in turn therein pilot pressurized fluid outlet ports 6, an inlet port 8, and a reservoir port 10, all of which are communicated with each other through the valve holes 2. The inlet port 8 communicates with a pilot pressurized fluid supply pump 7, and the reservoir port 10 communicates with a fluid reservoir 9.

Pistons 11 are axially slidably mounted in the upper part of the valve body 1 at positions opposite to the valve spools 3 which are inserted in the above-mentioned plurality of valve holes 2, respectively. The upper end of each of the pistons 11 is biased against and kept in contact with the lower end surface of a pusher member 20 projecting from the valve body 1 and which is connected to an operating lever 18, by the resiliency of a spring 16.

Each valve spool 3 is slidably inserted in each of the valve holes 2 in such a manner that the base end surface 3*b* thereof faces the corresponding outlet port 6, and the leading end portion 3*c* thereof is fitted in a blind hole 12 formed in the base end of each of the pistons 11. The arrangement is made such that when the operating lever 18 is tilted in the direction shown by arrow each of the valve spools 3 is allowed to slidably move down in the drawing through the respective piston 11 and spring 16 against the resilient force of a spring 14.

The downward sliding movement of the valve spools 3 allows the pilot fluid under pressure which is supplied by the pump 7 into the inlet port 8 to flow through the holes 4 and 5 formed in each of the valve spools 3 into the respective outlet port 6.

The discharge rate of the pilot fluid under pressure which is allowed to flow into the outlet ports 6 is usually controlled in such a way as to increase in proportion to the stroke of the operating lever as shown, for example, by solid line in FIG. 3. Whilst, in the above-mentioned prior art hydraulic pilot valve unit, when the operating lever 18 is tilted, the valve spools 3 are slidably moved down in the same manner through the springs 16 in accordance with the movement downward sliding movement in the drawing) of the pistons 11. Therefore, when the operating lever 18 is tilted suddenly, the pistons 11 are slidably moved down quickly so as to deflect the springs 16 quickly. However, because of the weak resilient force of the springs 16, the deflection thereof will not provide momentarily a force to depress the valve spools 3 so that there is a time delay until the downward sliding movement of the valve spools 3 occurs. As a result, the relationship between the stroke of the operating lever 18 and the discharge rate of the pilot fluid under pressure will become as shown by dotted line in FIG. 3.

In brief, changes in the operating speed of the operating lever 18 result in changes in the discharge rate of pilot fluid under pressure relative to the stroke of the operating lever. When operating an implement of a hydraulic actuator or the like adapted to be operationally controlled by a pilot fluid actuated type change-over valve, etc. incorporating such a hydraulic pilot valve unit, it becomes difficult for the operator to manipulate the work implement of the construction vehicle to his will.

SUMMARY OF THE INVENTION

The present invention has been made in view of the above-mentioned circumstances, and has for its object to provide a hydraulic pilot valve unit wherein valve spools for controlling the discharge rate of pilot fluid under pressure are moved accurately in accordance with the operation of an operating lever, and the discharge rate of pilot fluid under pressure can be varied in proportion to the stroke of the operating lever irrespective of the operating speed of the operating lever.

To achieve the above-mentioned object, according to the aspect of the present invention, there is provided a hydraulic pilot valve unit, characterized in that it comprises a valve body; valve spools mounted slidably in a plurality of axially extending valve holes formed within the valve body and along the circumference of the latter, said valve spools being slidably movable freely between a first position where pilot pressurized fluid outlet ports formed on one side of the valve body and continuously with the valve holes, respectively, are allowed to communicate with an inlet port formed in the valve body so that the outlet ports may communicate with a pilot pressurized fluid supply pump, and a second position where the outlet ports are allowed to communicate with a reservoir port so that the outlet ports may communicate with a fluid reservoir, a plurality of pistons mounted axially slidably in the valve body on the other side thereof and arranged such that they may be aligned with the spools and their respective leading ends may project from the valve body; an operating lever connected with a pusher member, which is kept in contact the projecting leading end of each of the pistons, and adapted, to move the pusher member down towards the side of the pistons when it is tilted manually by the operation; first compression springs each being mounted between the valve body and the piston so as to bias manually each of the pistons towards the pusher member; second compression springs each being mounted between the piston and the valve spool so that movement of each of the pistons by the operating lever in one direction may cause movement of each of the valve spools to the first position; damper pistons each being mounted slidably in a cylinder hole formed in each of the pistons on the opposite side of the pusher member so as to extend axially from the base end face of each of the pistons, thereby defining a damper chamber in the cylinder hole; and damper orifices each being formed in each of the damper pistons so as to allow the damper chambers to communicate with the reservoir port formed in the valve body, the arrangement being made such that each of the damper pistons is abutted against one end of each of the valve spools by the resilient force of a third compression spring mounted between each of the damper pistons and the innermost wall of each of the cylinder holes so as to block each of the damper orifices.

The hydraulic pilot valve unit incorporating the above-mentioned aspect has the following advantages.

Even when the operating lever is manipulated suddenly by the operator, the damper pistons are moved together with the pistons by a damper effect created in the damper chambers thereby moving the valve spools so that the latter may be moved without any time delay, and hence the discharge rate of pilot fluid under pressure may be varied in proportion to the stroke of the operating lever.

Further, even when the operating lever is manipulated by the operator in the opposite direction from the condition that the valve spools have been moved down in the drawing thereby moving the pistons to their inoperative condition, the damper pistons are each kept continuously in contact with one end face of each of the valve spools so that the damper orifices may be kept closed. Subsequently, when the pistons are moved again by means of the operating lever, a damper effect is created in the damper chambers so that the valve spools may be moved smoothly to their second positions without any time delay in the same manner as mentioned above.

Thus, in operating an implement actuated by a pilot fluid actuated type changeover valve or the like adapted to be controlled for switch-over by the hydraulic pilot valve unit according to the present invention, it becomes possible for the operator to manipulate the implement easily and to his will.

The above-mentioned and other objects, aspects and advantages of the present invention will become apparent to those skilled in the art by making reference to the following detailed description and accompanying drawings in which a preferred embodiment incorporating the principles of the present invention is shown by way of example only.

DETAILED DESCRIPTION OF PREFERRED EMBODIMENT

The present invention will now be described below by way of example only with reference to FIGS. 2 to 4E.

Figure 1:
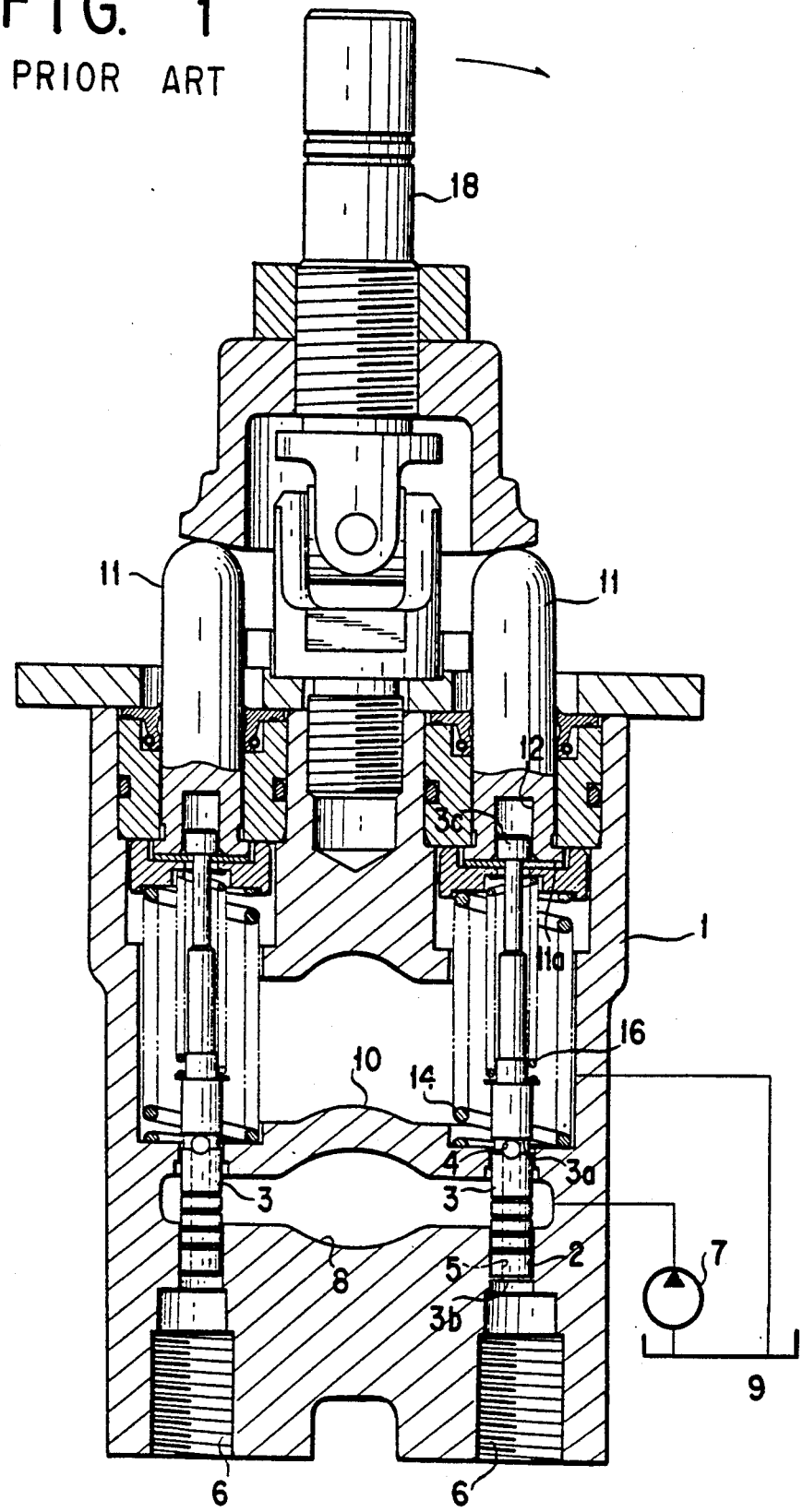
FIG. 1 PRIOR ART
FIG. 1 is a longitudinal sectional view of an embodiment of the conventional hydraulic pilot valve unit.
Figure 2:
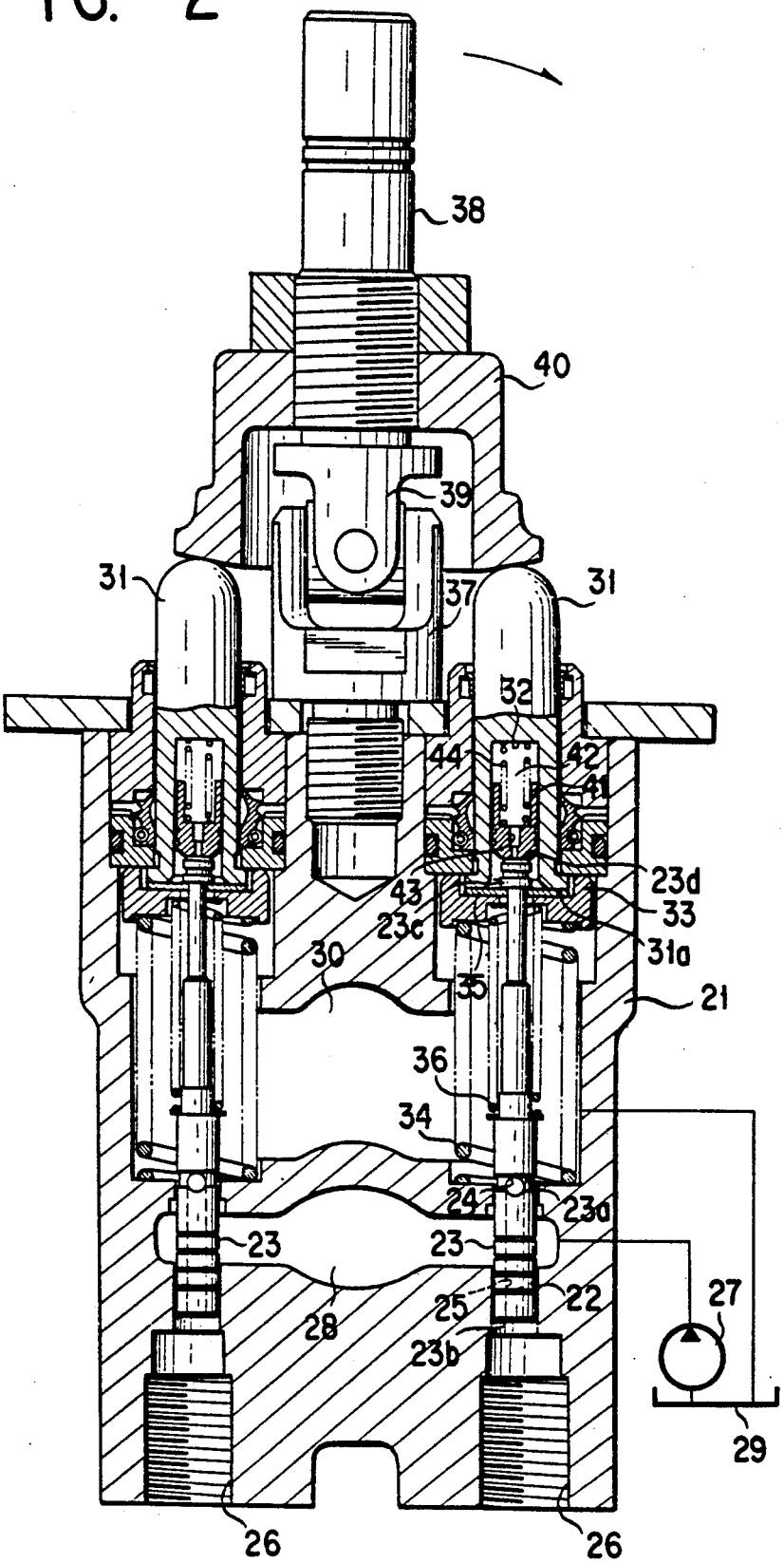
FIG. 2 is a longitudinal sectional view of an embodiment of the present invention.
Figure 3:
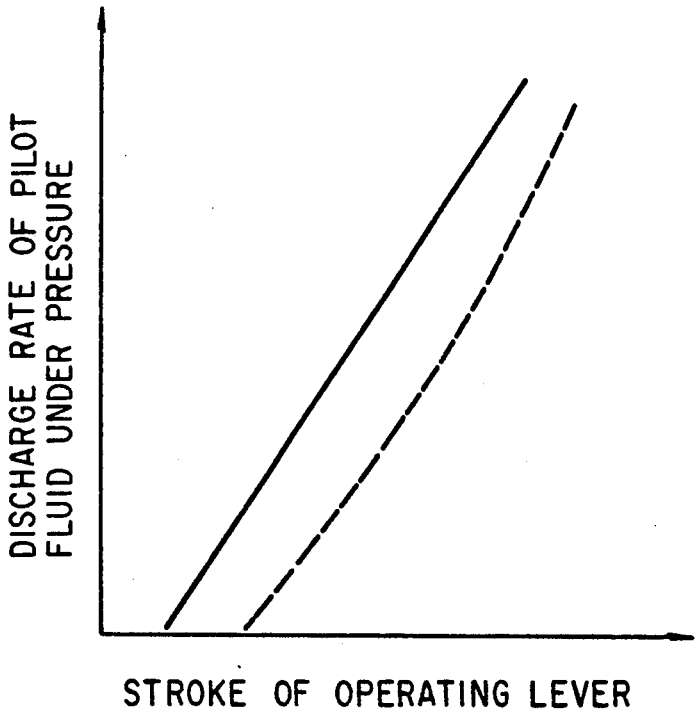
FIG. 3 is a graph showing the relationship between the stroke of the operating lever and the discharge rate of pilot fluid under pressure.
Figure 4A:
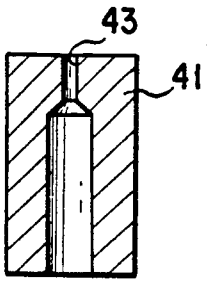
FIGS. 4A to 4E are longitudinal sectional views showing various examples of the damper piston.
Figure 4B:
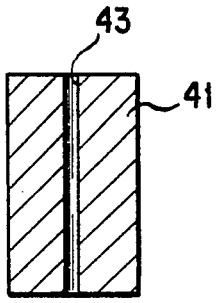
Figure 4C:
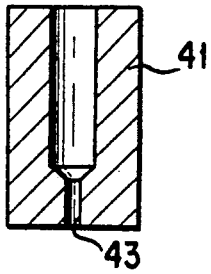
Figure 4D:
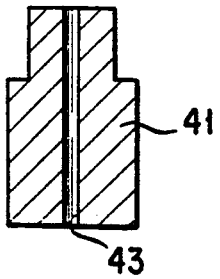
Figure 4E:
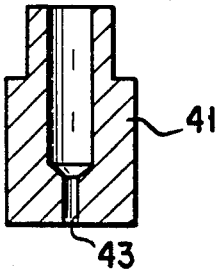

Referring to FIG. 2, the hydraulic pilot valve unit comprises a valve body 21 having a plurality of axially extending valve holes 22 formed within the valve body in the circumferential direction thereof, and a valve spool 23 is slidably mounted in each of the valve holes 22. Each of the valve spools 23 has formed therein a radial hole 24 for pressurized fluid which opens in a small diameter portion 23*a* formed on the approximately intermediate axial portion thereof, and an axial hole 25 for pressurized fluid, one end of which communicates with the radial hole 24 and the other end of which opens in the base end surface of the valve spool.

The valve body 21 has further formed axially in turn therein pilot pressurized fluid outlet ports 26, an inlet port 28 and a reservoir port 30, all of which are communicated with each other through the valve holes 22. The inlet port 28 communicates with a pilot pressurized fluid supply pump 27, and the reservoir port 30 communicates with a fluid reservoir 29.

Pistons 31 are axially slidably mounted in the upper part of the valve body 21 at positions opposite to the valve spools 23 which are inserted in the above-mentioned valve holes 22, respectively. The upper end of each of the pistons 31 is biased against and kept in contact with the lower end surface of a pusher member 40 projecting from the valve body 21 and which is connected to an operating lever 38, by the resiliency of a first compression spring 34.

Each valve spool 23 is slidably inserted in each of the valve holes 22 in such a manner that the base end face 23*b* thereof faces the corresponding outlet port 26, and the leading end portion 23*c* thereof is fitted in a blind hole 32 formed in the base end of each of the pistons 31. The arrangement is made such that when the operating lever 38 is tilted in the direction shown by arrow each of the valve spools 23 is allowed to slidably move down in the drawing to a first position through the respective piston 31 and first compression spring 34 end against the resilient force of a second compression spring 36. Further, each of the first springs 34 is mounted between a spring retainer 33 of the piston 31 and the valve body 1 so as to bias normally each of the pistons 31 towards the pusher member 40.

As a result of the downward sliding movement of the valve spools 23, the pilot fluid under pressure which is supplied by the pump 27 into the inlet port 28 is allowed to flow through the holes 24 and 25 formed in each of the valve spools 23 into the respective outlet port 26.

Each of the above-mentioned pistons 31 has a cylinder hole 32 formed therein in the shape of a blind hole and which is perforated to open into the reservoir port 30. A damper piston 41 is inserted in the cylinder hole 32 so as to define a damper chamber 42. The damper piston 21 has a narrow axially extending passage (or damper orifice) 43 formed in the approximately central part thereof so that the damper chamber 42 may be communicated with the reservoir port 30. Since the damper piston 41 is normally biased outwardly by a third compression spring 44 mounted within the damper chamber so as to abut against the leading end face of the valve spool 23, the damper orifice 43 is normally blocked by the leading end face 23*d*.

Further, one end face 31*a* of the piston 31 is abutted through a spring retainer 33 and a spacer 35 located thereunder against a first compression spring 34. A second compression spring 36 is mounted between the spring retainer 33 and a shoulder formed in the intermediate portion of the valve spool 23 so as to bias the valve spool 23 to a predetermined position so that the leading end 23c thereof may be abutted against the spacer 35 thereby holding the valve spool 23 at a second position; that is; a draining position, where the inlet port 28 is communicated through the holes 25 and 24 with the reservoir port 30. The above-mentioned valve body 21 has a mounting rod 37 screwed in the upper part thereof. An operating lever 38 is connected through a cross joint 39 to the mounting rod 37 so that it may be swung freely to the front and rear and to the left and right. A pusher member 40 mounted on the cross joint 39 is abutted against the above-mentioned pistons 31. When the operating lever 38 is swung or tilted in the direction shown by arrow, to urge each of the pistons 31 down in drawing to thereby move the spring retainer 33 down against the resiliency of the first compression spring 34, each of the valve spools 23 is moved down by the piston 31 and the damper piston 41 to the above-mentioned first position underneath. As a result, the holes 24 formed in the valve spools 23 will communicate with the inlet port 28 so that the pilot fluid under pressure in the inlet port 28 may be supplied through the holes 24 and 25 into the outlet ports 26.

Thus, in the hydraulic pilot valve unit constructed as mentioned hereinabove, even when the operating lever 38 is operated quickly, owing to the damper effect developed in the damper chambers 42, the valve spools 23 are moved down by the combined action of their damper pistons 41 and pistons 31. Therefore, movement of the valve spools 23 can be made without time delay inherent to the prior art pilot valve unit. As a result, as shown by solid line in FIG. 3, pilot fluid under pressure is discharged from the outlet ports 26 in proportion to the stroke of the operating lever, irrespective of the speed of operation of the operating lever 38.

Further, when the operating lever 38 is operated reversely from the condition that it has been operated in the direction shown by arrow with the valve spools 23 assuming their lower positions, the pistons 31 are moved upwards by the resilient force of their first compression springs 34 so that there is a tendency of creating a clearance between the damper piston 41 and the leading end face 23*d* of the value spool 23. However, since each of the damper pistons 41 is biased downwardly in the drawing by a third compression spring 34, the damper piston 41 is still kept in contact with the leading end face 23*d* of the valve spool 23 to thereby close the damper orifice 43. Therefore, when the operating lever 38 is operated again in the direction shown by arrow, the damper effect can be obtained.

The above-mentioned damper piston 41 may be formed in any of shapes as shown in FIGS. 4A to 4E. In brief, it is only necessary to form the piston 41 in such a manner that the damper orifice 43 can be blocked or closed by the leading end face of the valve spool 23.

Further, it is also possible to change the diameter of the damper orifice 43 to thereby regulate the damper effect so that the discharge rate of pilot fluid under pressure can be varied in accordance with the speed of operation of the operating lever 38.

Further, since the damper piston 41 is urged by the resiliency of the third compression spring 44 against one end face of the valve spool 23, the damper piston may be arranged to slidably move in the horizontal direction in the drawing, and hence the piston 31 and the valve spool 23 may be arranged to slidably move in the horizontal direction.

What is claimed is:

1. A hydraulic pilot valve unit, characterized in that it comprises a valve body; valve spools mounted slidably in a plurality of axially extending valve holes formed within the valve body and along the circumferential of the latter, said valve being slidably movable freely between a first position where pilot pressurized fluid outlet ports formed on one side of said valve body and continuously with the valve holes, respectively, are allowed to communicate with an inlet port formed in said valve body so that the outlet ports may communicate with a pilot pressurized fluid supply pump, and a second position where said outlet ports are allowed to communicate with a reservoir port so that the outlet ports may communicate with a fluid reservoir, a plurality of pistons mounted axially slidably in the valve body on the other side thereof and arranged such that they may be aligned with said spools and their respective leading ends may project from the valve body; an operating lever connected with a pusher member, which is kept in contact with the projecting leading end of each of the pistons, and adapted to move the pusher member down towards said pistons when it is tilted manually by the operator; first compression springs each being mounted between the valve body and each of the pistons so as to bias normally each of the pistons towards said pusher member; second compression springs each being mounted between the piston and the valve spool so that movement of each of said pistons by the operating lever in one direction may cause movement of each of said valve spools to the first position; damper pistons each being mounted slidably in a cylinder hole formed in each of said pistons on the opposite side of said pusher member so as to extend axially from the base end face of each of said pistons, thereby defining a damper chamber in the cylinder hole; and damper orifices each being formed in each of said damper pistons so as to allow the damper chambers to communicate with the reservoir port formed in the valve body, the arrangement being made such that each of said damper pistons is abutted against one end of each of said valve spools by the resilient force of a third compression spring mounted between each of the damper pistons and the innermost walls of each of the cylinder holes so as to block each of said damper orifices.

* * * * *